US007922103B2

(12) United States Patent
Houstoun

(10) Patent No.: US 7,922,103 B2
(45) Date of Patent: Apr. 12, 2011

(54) DECORATIVE WATERFALL

(76) Inventor: David T. Houstoun, Eustis, FL (US)

( * ) Notice: Subject to any disclaimer, the term of this patent is extended or adjusted under 35 U.S.C. 154(b) by 115 days.

(21) Appl. No.: 12/321,925

(22) Filed: Jan. 28, 2009

(65) Prior Publication Data

US 2010/0187325 A1 Jul. 29, 2010

(51) Int. Cl.

| | |
|---|---|
| ***B05B 17/08*** | (2006.01) |
| ***B05B 1/00*** | (2006.01) |
| ***F21S 8/00*** | (2006.01) |
| ***G09F 19/00*** | (2006.01) |

(52) U.S. Cl. ..... 239/20; 239/17; 239/18; 239/211; 40/406

(58) Field of Classification Search ..... 239/12, 239/16–18, 20, 21, 193, 211, 289; 40/406; 362/96, 101, 318

See application file for complete search history.

(56) References Cited

U.S. PATENT DOCUMENTS

| | | | | |
|---|---|---|---|---|
| 2,503,945 | A | 4/1950 | Grossniklaus | |
| 4,747,538 | A | 5/1988 | Dunn et al. | |
| 4,836,142 | A | 6/1989 | Duback | |
| 5,167,368 | A | 12/1992 | Nash | |
| 5,445,322 | A | 8/1995 | Formhals et al. | |
| 6,149,070 | A | 11/2000 | Hones | |
| 6,152,381 | A | 11/2000 | Hones | |
| 6,279,835 | B1 * | 8/2001 | Hansen | 239/20 |
| 6,290,144 | B1 | 9/2001 | Maxwell | |
| 6,382,520 | B1 | 5/2002 | Hones | |
| 6,405,937 | B1 | 6/2002 | Stukenberg | |
| 6,447,137 | B1 * | 9/2002 | Long | 362/96 |
| 6,634,138 | B2 | 10/2003 | Katzman | |
| 6,901,925 | B2 | 6/2005 | Coughlin | |
| 7,296,785 | B2 | 11/2007 | Hayden | |
| 7,344,124 | B2 | 3/2008 | Hayden | |
| 2005/0258268 | A1 * | 11/2005 | Watson et al. | 239/17 |
| 2006/0023469 | A1 * | 2/2006 | Chernoff et al. | 362/565 |
| 2007/0023032 | A1 | 2/2007 | Wheeler | |

* cited by examiner

*Primary Examiner* — Darren W Gorman

(74) *Attorney, Agent, or Firm* — William M. Hobby, III

(57) ABSTRACT

The present invention relates to a decorative waterfall apparatus and more particularly to a decorative waterfall having a decorative image on a backboard which can be rapidly changed by removing the removable mounted backboard and changing a polymer film having a decorative image thereon extending thereover.

10 Claims, 3 Drawing Sheets

DECORATIVE WATERFALL

BACKGROUND OF THE INVENTION

The present invention relates to a decorative waterfall and more particularly to a decorative waterfall having a decorative image on a backboard which can be rapidly changed by removing the removable mounted backboard and also by changing a polymer film covering thereover having a decorative image thereon.

Moving water or waterfalls used as decorative elements in a home or public building are well-known. These include various types of fountains which can be small fountains placed on a table, large permanently installed fountains, or decorative waterfall devices attached to a building to produce the pleasant effects of falling water within the building. In some buildings, these are seen as water falling between two transparent glass plates. Typically, the water is collected in a pool at the bottom of the artificial waterfall and is pumped through a pipe for dispersion at the top of the waterfall to provide a continuous circulation of water. The freefalling water can be falling directly to the pool below or over a backboard into the pool.

The present invention relates to a decorative waterfall having an image displayed on a backboard behind the falling water and which backboard is rapidly removable from the decorative waterfall for changing the image thereon. The image may be changed by attaching a polymer film over the backboard with snaps or fasteners, which polymer film has a decorative image thereon. This allows the decorative image of the waterfall to be rapidly replaced and can, for instance, have a different image for different holidays, such as Christmas, Halloween or the like.

Prior art decorative waterfalls may be seen in the Nash U.S. Pat. No. 5,167,368 in which a decorative waterfall has a housing with a reservoir of water at the bottom of the housing and a pump for conveying water from the bottom reservoir to a top reservoir where the water overflows the top reservoir and flows down a front wall. The Dunn et al. U.S. Pat. No. 4,747,538 is a decorative waterfall and also provides humidification in the building and uses a plurality of overlapping panels for the water to flow across. The Hones U.S. Pat. No. 6,149,070 is a decorative waterfall having a continuous flow of water which is illustrated having the water flowing over potted plants. Similarly, the Katzman U.S. Pat. No. 6,634,138 has a self-sustaining indoor waterfall planter.

The Formhals et al. U.S. Pat. No. 5,445,322 is an apparatus for projecting water to form an insubstantial screen for receiving images thereon and thus includes a vertical sheet of water and an image projector directing an image onto the water. In the Wheeler U.S. Patent Publication No. 2007/0023032 and the A. J. Grossniklaus U.S. Pat. No. 2,503,945 and the Coughlin U.S. Pat. No. 6,901,925, each show a decorative waterfall combined with a fireplace. Decorative waterfalls which produce a water curtain can be seen in the Hayden U.S. Pat. No. 7,296,785 and in the Hones U.S. Pat. Nos. 6,382,520 and 6,152,381 and in the Hayden U.S. Pat. No. 7,344,124. Other decorative waterfalls may be seen in the Stukenberg U.S. Pat. No. 6,405,937 for a system of modular rocks with a waterfall and in the Maxwell U.S. Pat. No. 6,290,144 for a decorative waterfall system and in the Duback U.S. Pat. No. 4,836,142 for an aquarium and waterfall system.

The present invention, in contrast to the prior art systems, is for a decorative waterfall with a decorative image on a backboard behind the falling water. The backboard can be quickly and easily removed and replaced or the image on its surface changed. This allows for the changing of the image from time to time during the year. The image may be changed by simply replacing a removable polymer film cover having an image formed thereon which can be attached with fasteners. The polymer film can be attached to the backboard in a manner to direct the dispersed water over the backboard.

SUMMARY OF THE INVENTION

A decorative waterfall has a waterfall housing having a top and bottom portion and having a base having a water reservoir therein and a pair of sidewalls extending generally vertically from the base to the top portion of the housing. A water dispersion tube is located in the top portion of the waterfall housing and a pipe extends between the water reservoir and the dispersion tube for conveying water in the water reservoir to the dispersion tube. A pump is connected to the pipe for pumping water from the water reservoir. A removably mounted decorative backboard is removably attached between the side walls of the housing and positioned for water from the dispersion tube to flow thereover. The backboard has a pair of side edges and a decorative image on the surface thereof so that the waterfall has a changeable decorative backboard for easy changing of the image behind the water flowing thereover.

The backboard decorative surface includes a polymer film cover having a decorative image to cover the one side of the backboard and is removably attached to the backboard for rapidly changing the image displayed on the backboard behind the falling water. The backboard is supported with pegs protruding from each edge thereof which can be rapidly positioned in slots in the sidewalls of the housing which positions and supports the backboard. The backboard has a plurality of fastener portions thereon for removably attaching a polymer film thereto, which polymer film has a decorative image thereon. The polymer film can be attached to the backboard with snap fasteners or the like.

The backboard has a top edge which has an elongated ledge extending thereacross for attaching the polymer film thereover to provide a sloping surface to the top edge of the backboard for directing water from the dispersion tube over the backboard decorative surface. A lamp is mounted in the base for directing light onto the backboard to light the decorative image and flowing water.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
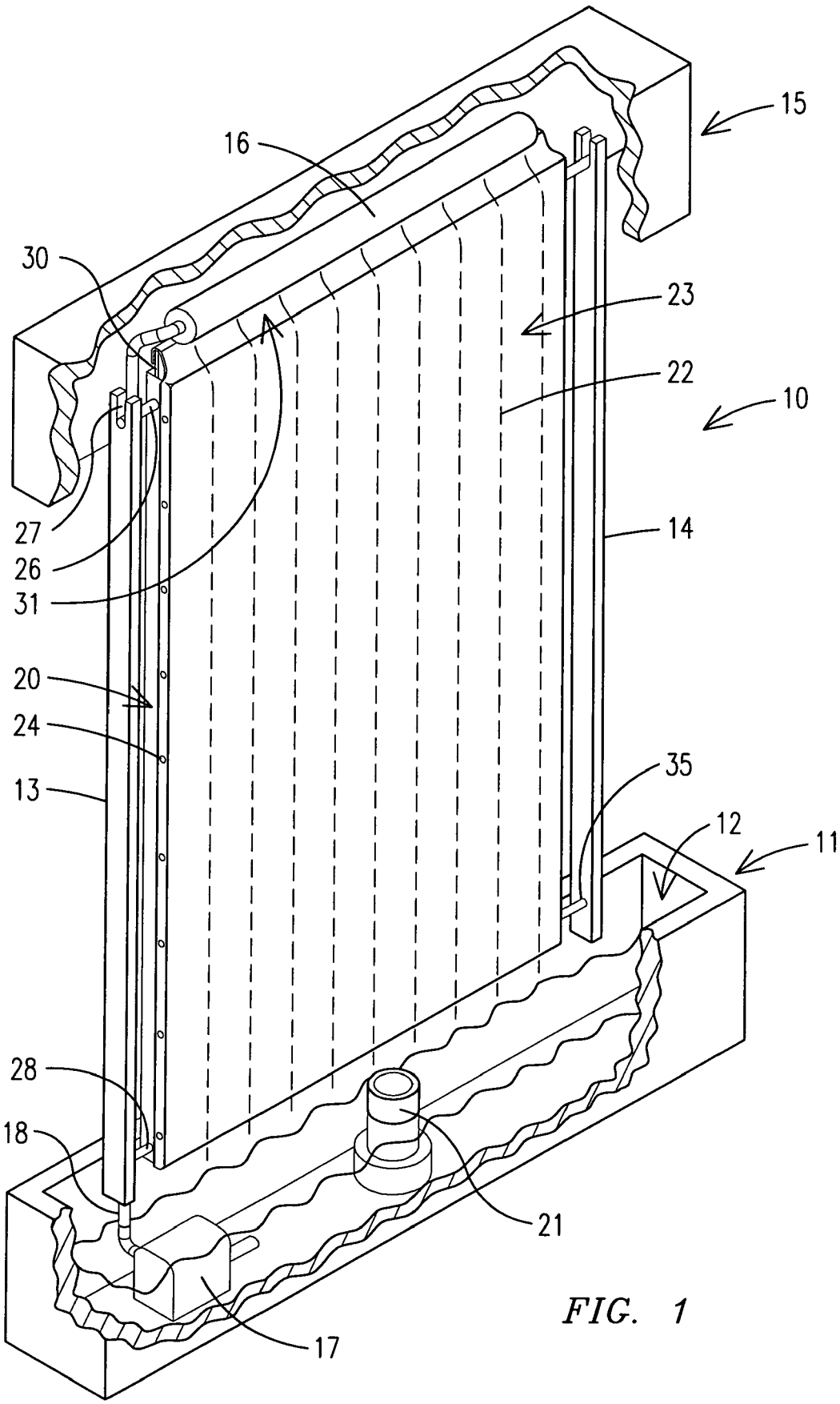
FIG. 1 is a cut-away perspective view of a decorative waterfall in accordance with the present invention.
Figure 2:
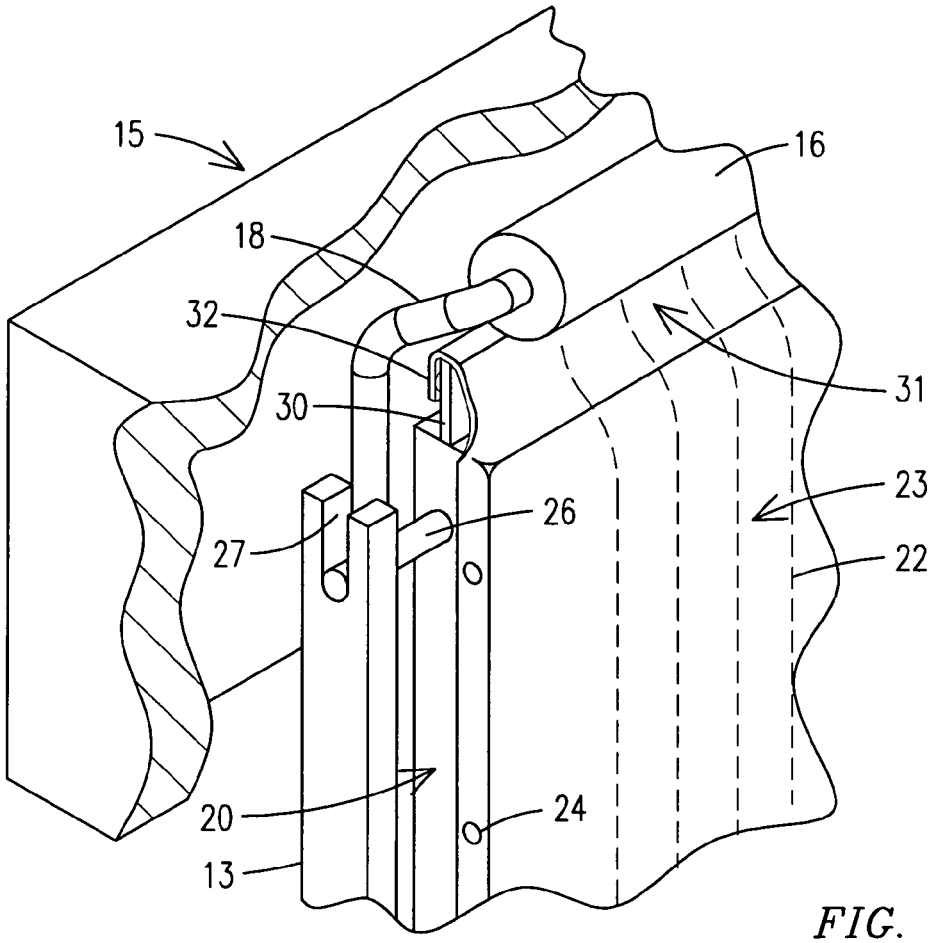
FIG. 2 is a partial cut-away perspective of a corner of the decorative waterfall of FIG. 1.
Figure 3:
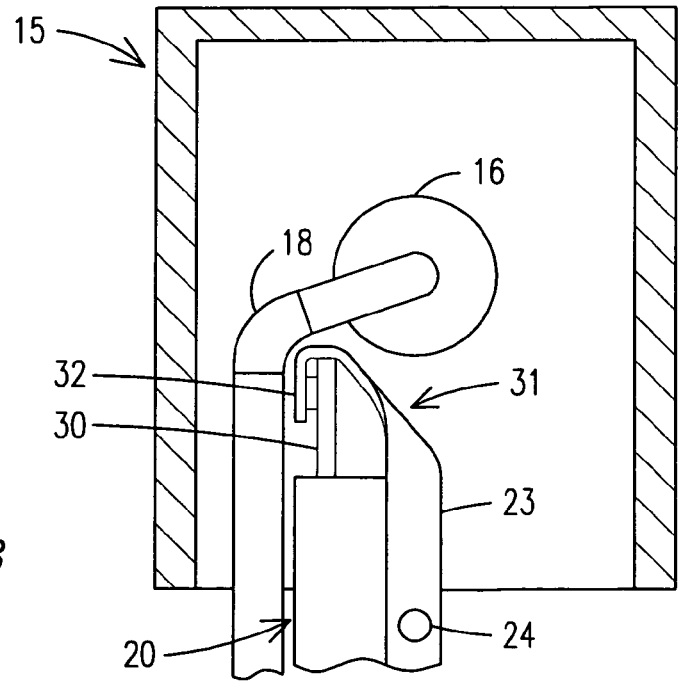
FIG. 3 is a sectional view of a portion of the waterfall of FIG. 1.
Figure 4:
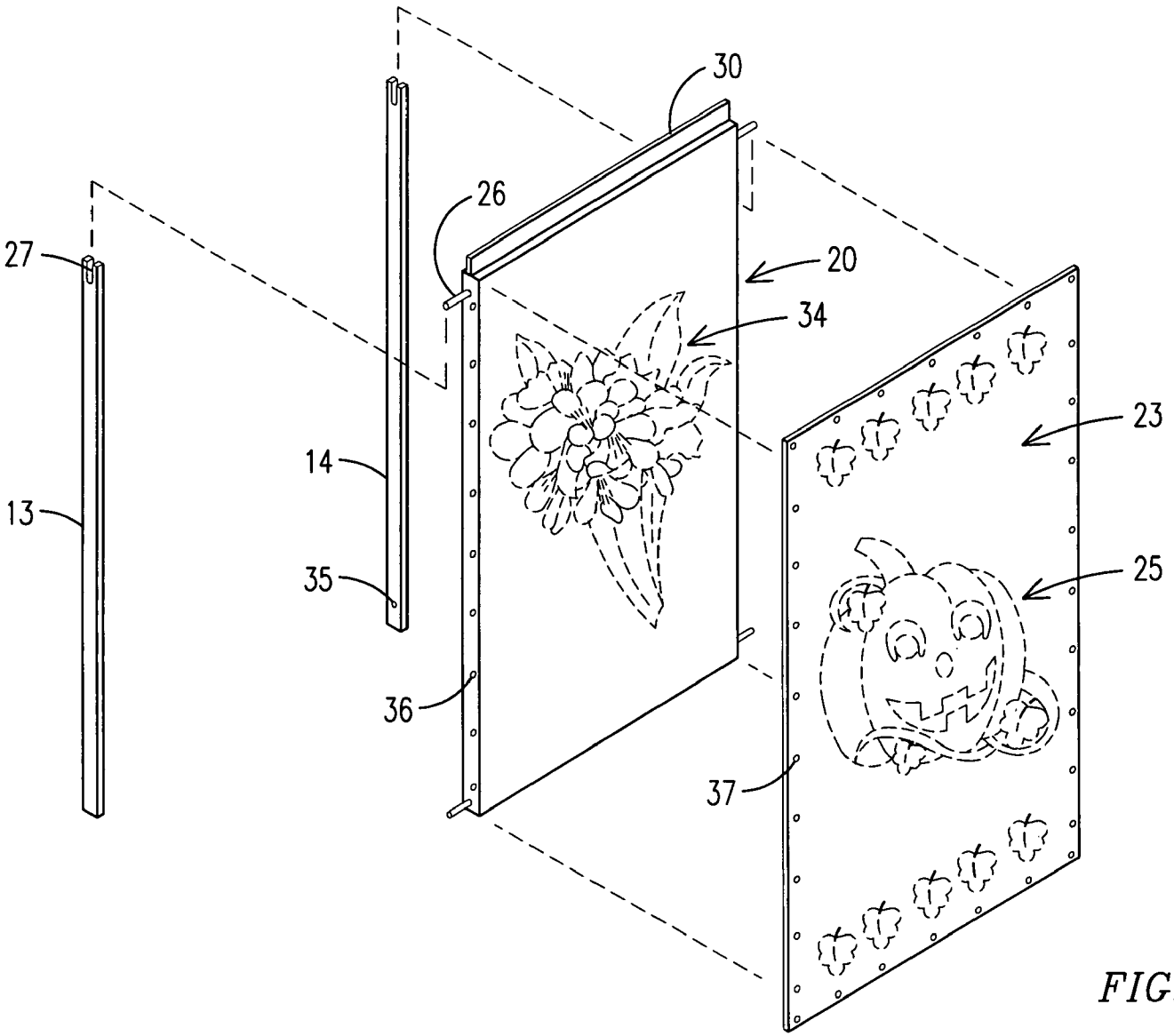
FIG. 4 is an exploded view of the removable backboard and polymer film covering of the waterfall of FIG. 1.

Referring to the drawings FIGS. 1 through 3, a decorative waterfall 10 is provided with a base 11 having a pool of water 12 therein and having sidewalls 13 and 14 attached to the base 11 and extending generally vertically therefrom. A top cover 15 covers the top portion of the waterfall 10 and covers the dispersion tube 16 which has a plurality of openings therein for dispersing water therefrom. A pump 17 may be located in the base and pumps water through a tube 18 from the water pool 12 to the dispersion tube 16 where the water is dispersed into a waterfall over a backboard 20 where it flows into the water pool 12 in the base 11. The base 11 also has a lamp 21 mounted therein and is directed towards the flowing water 22 and the backboard 20. The backboard 20 can be seen to have a polymer film cover 23 placed thereover and attached over the backboard 20 with a plurality of fasteners 24. The polymer film 23 is a waterproof film which has a decorative image 25 as seen in FIG. 4. The backboard 20 can be seen as having protruding pegs 26 protruding from the sides thereof which may be steel pegs or may be made of any material desired. The pegs are shown in FIGS. 1 and 2 snapped into the upper slots 27 for supporting the backboard 20 in a generally vertical position. The backboard 20 may also have protruding pegs 28 on the bottom thereof which may be spring loaded for insertion into an opening in the sidewalls 13 and 14. This allows the backboard to be rapidly removed by simply unhooking the protruding pegs 28 on the bottom and raising the backboard to raise the pegs 26 from the slots 27 in the sidewalls 13 and 14 to remove the backboard from the waterfall 10. The backboard 20 can also be seen having a protruding ledge 30 positioned back from the front of the backboard to allow the polymer film 23 to overlap to form a generally angled surface 31 which directs the water being dispersed by the dispersion tube 16 thereonto and over the front of the backboard 20. The elongated ledge 30 can have the polymer film 23 attached to the back thereof with fasteners 32, as seen in FIGS. 2 and 3.

Turning to FIG. 4, an exploded view of the backboard having a decorative design 34 thereon is shown removed from the waterfall housing by the lifting of the backboard 20 to raise the pegs 26 from the slot 27 in the sidewalls 13 and 14 after loosening the pegs 28 from the openings 35 in the bottom of the sidewalls 13 and 14. Once the backboard is removed, a polymer cover 23 having a decorative design 25 is placed over the face of the backboard 20 and the snap portions 35 snapped over the opening 37 and onto the snapped portions 36 to form a waterproof film over the backboard 20. The top of the waterproof film 23 extends over the elongated ledge 30 to form a water path for the water flowing over the backboard 20 with the film cover 23 attached thereto. The backboard can then be rapidly reattached to the waterfall 10 housing allowing a user to change the image for a special event.

The image on the polymer film 23 can be of a Halloween scene, as shown in FIG. 4, or it can be a Christmas scene or any other decorative image desired. The image is then seen behind the falling water in the waterfall which is lighted by the lamp 21, lighting the falling water, and the image displayed behind the falling water. Images can also be seen painted onto the backboard 20, as shown in FIG. 4, but this would require repainting the image for each change while the images 25 on the film 23 can be printed thereon and numerous images printed onto different film covers provided with the waterfall.

It should be clear at this time that a decorative waterfall has been provided which advantageously allows the rapid removal of the backboard of the waterfall and the rapid changing of the image displayed on the backboard. However, the present invention is not to be construed as limited to the forms shown which are to be considered illustrative rather than restrictive.

I claim:

1. A decorative waterfall comprising:

a waterfall housing having top and bottom portions and having a base having a water reservoir adjacent the bottom thereof and a pair of side members extending generally vertically from said base to the top portion thereof;

a water dispersion source located in the top portion of said waterfall housing;

a pipe extending between said water reservoir and said water dispersion source for conveying water in said water reservoir to said dispersion source;

a pump connected to said pipe for pumping water from said water reservoir through said pipe and into said dispersion source;

a removably mounted decorative backboard removably attached between said side members and positioned for water from said dispersion source to flow thereover, said backboard having two sides and a pair of side edges; and a polymer film cover having a decorative image thereon covering one side thereof and removably attached to said backboard for rapidly changing the image displayed on said backboard behind the falling water;

whereby said waterfall has a removably mounted decorative backboard for changing the image behind the water flowing thereover.

2. The decorative waterfall in accordance with claim 1 in which said backboard has a top supporting peg protruding from each side edge thereof.

3. The decorative waterfall in accordance with claim 2 in which each said side member has a slot therein positioned for receiving one of said top supporting pegs.

4. The decorative waterfall in accordance with claim 1 in which said backboard has a plurality of fastener portions thereon for removably attaching said polymer film thereto.

5. The decorative waterfall in accordance with claim 4 in which said polymer film has a plurality of fastener portions thereon for attaching to said backboard fastener portions.

6. The decorative waterfall in accordance with claim 5 in which said backboard fastener portions and said film fastener portions are each snap portions.

7. The decorative waterfall in accordance with claim 3 in which said backboard has a bottom peg protruding from each said backboard side edge for engaging an opening in each said side member.

8. The decorative waterfall in accordance with claim 1 in which said backboard has a top edge having an elongated ledge extending thereacross.

9. The decorative waterfall in accordance with claim 8 in which said polymer film extends over said backboard top edge elongated ledge to form a film surface for directing water from said dispersion source over said backboard decorative surface.

10. The decorative waterfall in accordance with claim 1 in which said base has a lamp mounted therein for directing light onto said backboard to light said decorative image thereon.

* * * * *